US006568369B1

(12) United States Patent
Desai et al.

(10) Patent No.: US 6,568,369 B1
(45) Date of Patent: May 27, 2003

(54) COMMON RAIL INJECTOR WITH SEPARATELY CONTROLLED PILOT AND MAIN INJECTION

(75) Inventors: Chetan J. Desai, Bloomington, IL (US); Xinshaung Nan, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/729,880

(22) Filed: Dec. 5, 2000

(51) Int. Cl.[7] ..... F02M 41/00

(52) U.S. Cl. ..... 123/467; 123/446

(58) Field of Search ..... 123/229, 300, 123/446, 467, 456, 447, 502, 506; 239/88–95; 251/129.01, 129.09

(56) References Cited

U.S. PATENT DOCUMENTS

| | | | | |
|---|---|---|---|---|
| 4,782,807 A | | 11/1988 | Takahashi | |
| 4,951,631 A | | 8/1990 | Eckert | |
| 5,056,488 A | | 10/1991 | Eckert | |
| 5,213,084 A | | 5/1993 | Linder et al. | |
| 5,477,834 A | * | 12/1995 | Yoshizu | 123/501 |
| 5,540,206 A | | 7/1996 | Heimberg | |
| 5,628,293 A | | 5/1997 | Gibson et al. | |
| 5,636,615 A | | 6/1997 | Shorey et al. | |
| 5,651,345 A | | 7/1997 | Miller et al. | |
| 5,758,622 A | | 6/1998 | Rembold et al. | |
| 5,775,301 A | * | 7/1998 | Ganser | 123/467 |
| 6,021,999 A | * | 2/2000 | English et al. | 251/64 |
| 6,053,421 A | * | 4/2000 | Chockley | 239/5 |
| 6,213,093 B1 | * | 4/2001 | Yudanov et al. | 123/446 |

FOREIGN PATENT DOCUMENTS

| | | |
|---|---|---|
| DE | 4118237 A1 | 12/1991 |
| GB | 2310889 A | 9/1997 |
| WO | WO 01/14727 A1 | 3/2001 |
| WO | WO 01/53696 A2 | 7/2001 |

OTHER PUBLICATIONS

English Language translation of "Heavy Duty Diesel Engines—The Potential of Injection Rate Shaping for Optimizing Emissions and Fuel Consumption", presented by Messrs. Bernd Mahr, Manfred Durnholz, Wilhelm Polach, and Hermann Grieshaber, Robert Bosch GmbH, Stuttgart, Germany, at the 21st International Engine Symposium, May 4–5, 2000, Vienna, Austria.

* cited by examiner

*Primary Examiner*—Willis R. Wolfe
*Assistant Examiner*—Mahmoud Gimie
(74) *Attorney, Agent, or Firm*—Liell & McNeil

(57) ABSTRACT

The present invention relates to common rail fuel injectors, and includes an example of such an injector, a fuel injection system employing such an injector, and a method of injecting fuel. The fuel injector includes an injector body, a fuel pressurization chamber, a nozzle chamber, a needle control chamber, a needle control spill outlet, a fuel inlet, and a nozzle outlet. The present fuel injection system includes a source of intermediate pressure fuel, a low pressure fuel reservoir, a needle valve, a flow control valve, and at least one of the present fuel injectors. The method of injecting fuel consists of the steps of injecting fuel at an intermediate pressure at least in part by fluidly connecting the injector's nozzle chamber to an intermediate fuel source, and injecting fuel at a high pressure at least in part by exposing a pressure intensifying element to the source of intermediate pressure fuel.

27 Claims, 4 Drawing Sheets

COMMON RAIL INJECTOR WITH SEPARATELY CONTROLLED PILOT AND MAIN INJECTION

TECHNICAL FIELD

The present invention relates generally to fuel injectors, and more particularly to common rail systems with the ability to produce separate pilot and main injections.

BACKGROUND ART

Common rail fuel injection systems have proven highly successful in diesel engine applications. Many of these injection systems use high pressure hydraulic fluid to actuate fuel injection. This has allowed great precision in controlling the initiation and termination of fuel injection, resulting in significant improvements in fuel efficiency and combustion burn quality over earlier systems. Furthermore, these systems have been shown to be highly versatile, allowing a great degree of control over injection rate shape.

The use of a common rail allows a simpler and more efficient fuel injection system design. A single pump can be used to pressurize fuel for injection. Using fuel itself as the actuation fluid can simplify the system further still. A separate delivery and return system for hydraulic fluid is no longer needed. Instead, the common rail is used to supply fuel for both combustion and injector actuation. However, these systems are not without problems. First, the use of high pressure fluid outside the injectors can result in fuel leakage to outside the system, creating serious safety concerns and compromising the systems' mechanical integrity. Second, these injection systems often have difficulty producing separate pilot and main injections. Third, prior art injection systems often do not offer adequately controlled injection initiation and termination when smaller volume injections are desired, such as during idle speed operation. Fourth, the ability to reliably inject at different pressures in a single injection cycle is problematic.

The present invention is directed to overcoming one or more of the problems and limitations set forth above.

DISCLOSURE OF THE INVENTION

In one aspect of the present invention, a fuel injector is provided which includes an injector body, a fuel pressurization chamber, a nozzle chamber, a needle control chamber, a needle control spill outlet, a fuel inlet, and a nozzle outlet. A pressure intensifying pumping element is provided which has a large hydraulic surface exposed to fluid pressure in the actuation fluid cavity, and a small hydraulic surface that is exposed to fluid pressure in the fuel pressurization chamber. The needle control chamber is fluidly connected to the fuel inlet and the needle control spill outlet. A needle valve is positioned in the injector body and includes a closing hydraulic surface that is exposed to fluid pressure in the needle control chamber. A flow control valve is attached to the injector body that is moveable between a first position in which the actuation fluid cavity is open to the fuel inlet, and a second position in which the actuation fluid cavity is closed to the fuel inlet.

In another aspect, a fuel injection system is provided which includes a source of intermediate pressure fuel, a pressure intensifying pumping element, a flow control valve, and a low pressure reservoir. The fuel injection system also includes at least one fuel injector having a needle valve, and an injector body defining a needle control chamber fluidly connected to a needle control spill outlet and a fuel inlet, and a nozzle outlet. An intermediate pressure supply line extends between the source of intermediate pressure fuel and the fuel inlet. A low pressure vent line extends between the needle control spill outlet and the low pressure reservoir. A pressure release valve is positioned in the vent line and has a first position in which the vent line is closed, and a second position in which the vent line is open.

In still another aspect, a method of injecting fuel is provided which includes the steps of injecting fuel at a high pressure at least in part by fluidly connecting a nozzle chamber of a fuel injector to a source of intermediate pressure fuel, and injecting the fuel at a high pressure at least in part by exposing a pressure intensifying element to the source of intermediate pressure fuel.

BEST MODE FOR CARRYING OUT THE INVENTION

Figure 1:
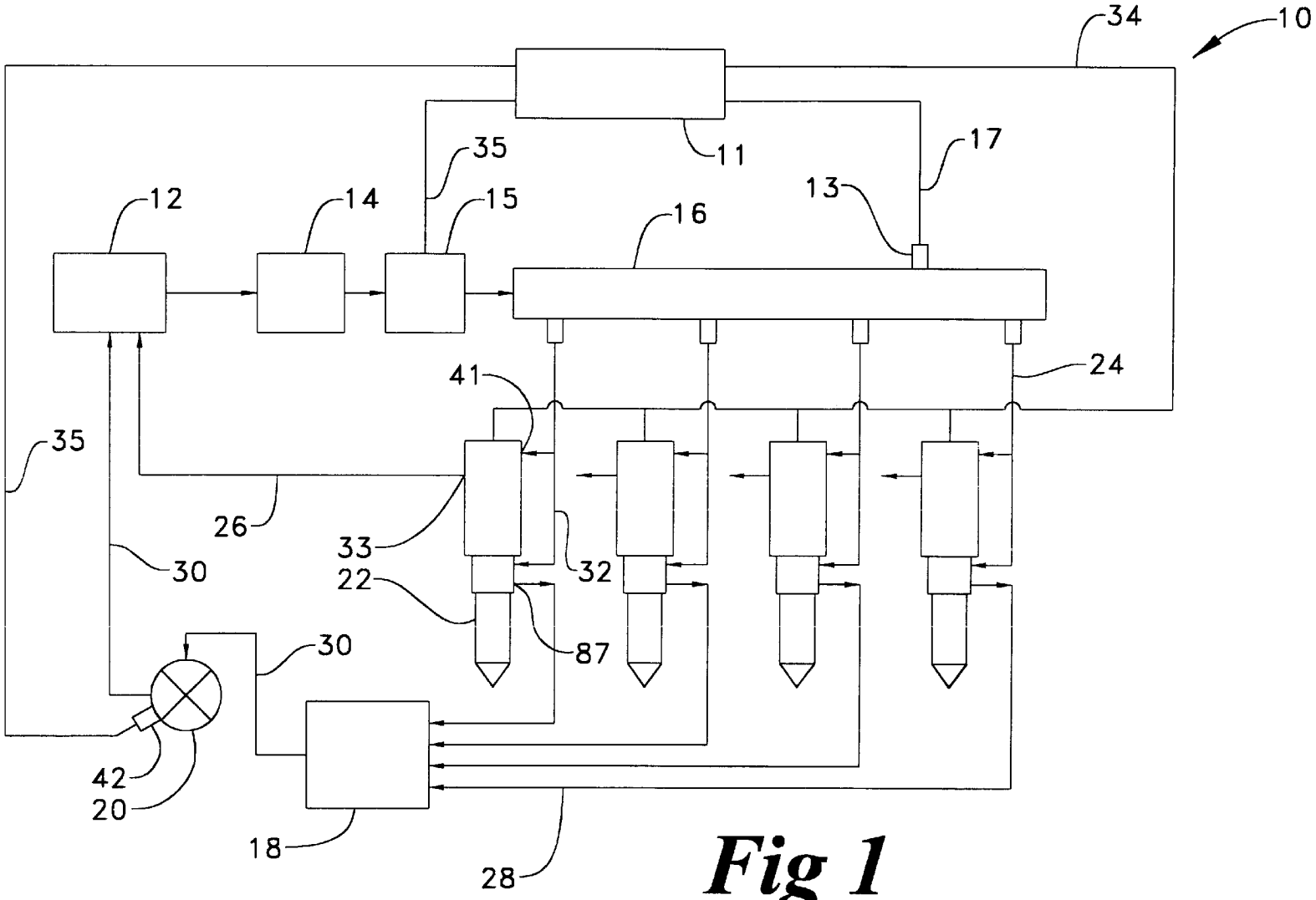
FIG. 1 is a system level schematic representation of a fuel injection system according to the present invention.

Referring now to FIG. 1, there is shown a system level diagram representing a fuel injection system 10 according to the present invention. Injection system 10 is controlled by an electronic control module 11 and includes a low pressure pump 14, an intermediate pressure pump 15, a common rail 16, and a plurality of fuel injectors 22. Injection system 10 also provides a flow control switch 18, a pressure reducing valve 20, and a low pressure reservoir 12, which is preferably the engine fuel tank. Injection system 10 circulates intermediate pressure fuel used to directly control pilot or idle speed fuel injection at the intermediate pressure, and hydraulically actuate main injection at a relatively high pressure.

Low pressure pump 14 supplies fuel from low pressure reservoir 12 to intermediate pressure pump 15, which pressurizes fuel and transfers it to common rail 16. From the common rail 16, a plurality of supply lines 24 supply fuel to a plurality of fuel injectors 22. Fuel pressure in common rail 16 is communicated via pressure sensor line 17 to electronic control module 11, and is preferably maintained between 20 and 40 MPa. Fuel enters an injector 22 via a fuel inlet 41, and is then supplied to various parts of the injector 22 where it is injected, used to directly control a pilot injection, or to hydraulically actuate main injection. Fuel used as actuation fluid drains out of the injector 22 through a low pressure fuel drain 33 from which it is returned to the low pressure fuel reservoir 12 for re-circulation via a low pressure drain line 26, only one of which is shown. A needle control spill outlet 87 is provided which vents the fuel pressure used to directly control pilot injection. Fuel draining from spill outlet 87 passes via a control pressure line 28 to the flow control switch 18.

Figure 2:
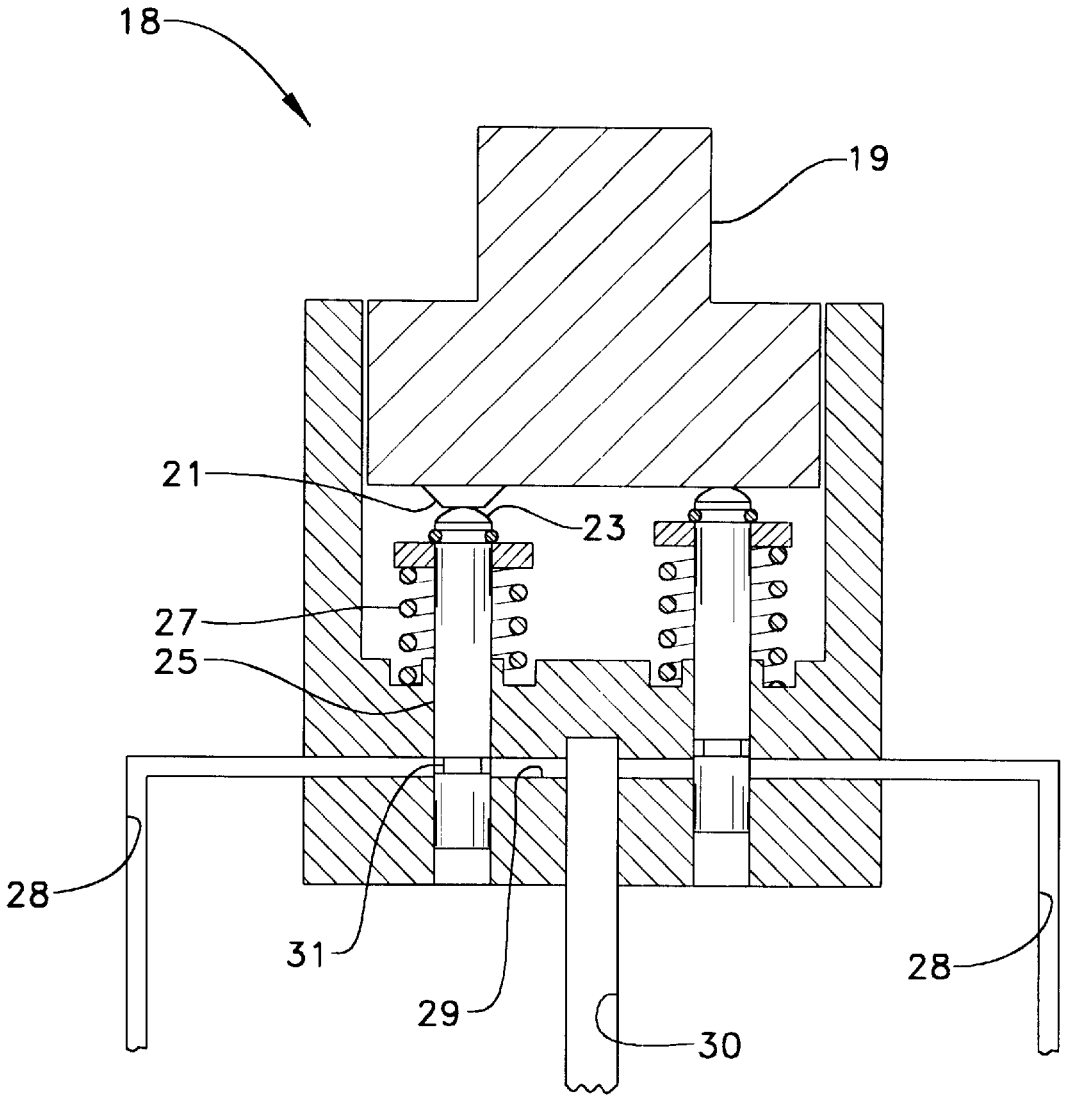
FIG. 2 is a sectioned side diagrammatic view of a flow control switch for use with the fuel injection system of the present invention.

Referring in addition to FIG. 2, there is shown a sectioned diagram of the flow control switch 18 for use with fuel injectors 22 of fuel injection system 10 from FIG. 1. Within flow control switch 18 are a number of spring biased flow control valve members 25, equal to the number of fuel injectors 22 included in fuel injection system 10. Each valve member 25 is biased toward a first position by a biasing spring 27, and includes a contact surface 23 which is preferably a convex surface. A cam 19 is included which can be rotated at half engine speed and is attached to the engine. As cam 19 rotates, a contact platform 21 is rotated which comes in contact with contact surface 23 of valve member 25. Contact platform 21 preferably includes sloped sides such that it can move smoothly over contact surface 23, moving valve member 25 to its second position. When valve member 25 is in its biased, first position, an annulus 31 included on valve member 25 is out of fluid communication with a drain passage 29 and a main passage 30 (vent line 30 from FIG. 1), which connects to pressure release valve 20. When valve member 23 is in its second position, annulus 31 provides fluid communication between main passage 30 and drain passage 29, which is connected to one of the low pressure lines 28. When annulus 31 is open to low pressure line 28 of a particular fuel injector 22, that fuel injector 22 is fluidly connected to vent line 30. Because of cam 19's rotation, flow control switch 18 has a plurality of positions, each of which exposes the low pressure line 28 of a different injector 22 to a vent line 30, which fluidly connects to pressure release valve 20. Pressure release valve 20 is positioned in vent line 30 and includes an electrical actuator 42 that moves it between an open and a closed position. Pressure release valve 20's electrical actuator is controlled with electronic control module 11, allowing fluid in vent line 30 to drain into low pressure reservoir 12 when valve 20 is opened. The rotation speed of cam 19 is preferably such that the length of time during which the low pressure line 28 of any given injector is in fluid communication with vent line 30, spanning a time period that could accommodate any injection event.

Electronic control module 11 controls the operation of the pressure intensifying aspect of each fuel injector 22 via a communication line 34 in a conventional manner, and also controls the pressure in the common rail 16 in a conventional manner, such as by control output of pump 15 via pump control line 36. The pressure in the common rail 16 is communicated to the electronic control module 11 from an attached pressure sensor 13 via pressure sensor line 17. Because the electronic control module 11 is also connected to intermediate pressure pump 15, intermediate pressure pump 15 can be precisely controlled to maintain the desired pressure in the common rail 16. Because pressure release valve 20's electrical actuator 42 is also controlled by electronic control module 11, via a control line 35, the open or shut state of pressure release valve 20 can also be precisely controlled.

Figure 3:
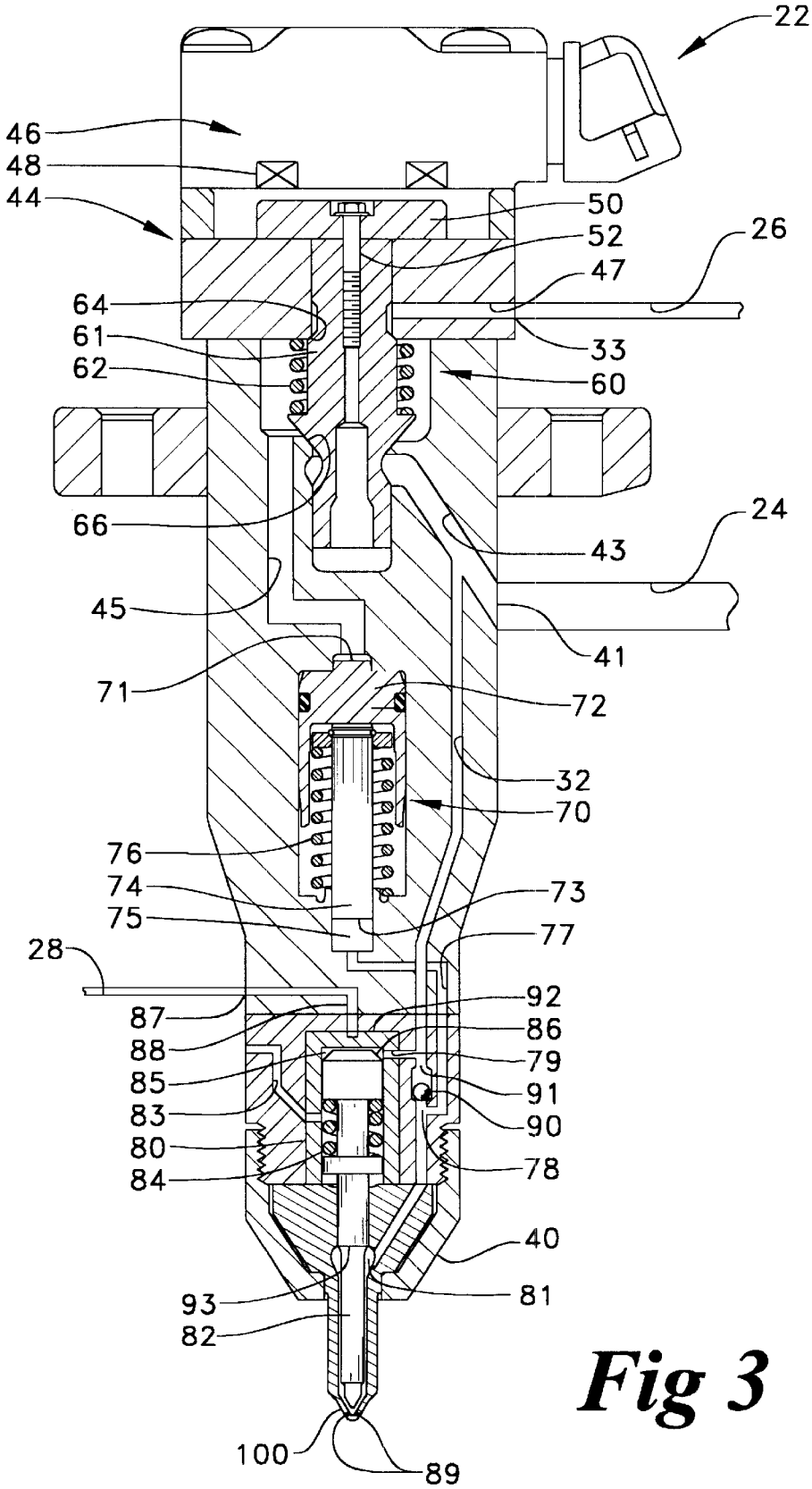
FIG. 3 is a sectioned side diagrammatic side view of a fuel injector according to the present invention.

Referring now to FIG. 3, there is shown a diagrammatic sectioned side view of a fuel injector 22 shown as part of injection system 10 in FIG. 1. Injector 22 has an injector body 40 and includes a flow control valve assembly 44, a pressure intensifying mechanism 70, and a needle valve 80. In the preferred embodiment, flow control valve assembly 44 is attached to injector body 40, though it should be appreciated that it could be positioned remote from injector body 40 without departing from the scope of the present invention. Flow control valve assembly 44 includes an electrical actuator 46 and a flow control valve 60. Electrical actuator 46, which is preferably a solenoid but could be some other suitable device such as a piezoelectric actuator, includes a coil 48 and an armature 50. Flow control valve 60 includes a valve member 61, which is attached to armature 50 of solenoid 46 with a screw 52. Energizing or de-energizing solenoid 46 moves valve member 61 between a first position in which it closes a low pressure seat 64, and a second position in which it closes an intermediate pressure seat 66. Injector body 40 defines an intermediate pressure passage 43 and an actuation fluid cavity 45 which are in fluid communication when valve member 61 is in its first position. When valve member 61 is in its second position, actuation fluid cavity 45 is fluidly connected to a low pressure fuel drain 47, also defined by injector body 40. Low pressure fuel drain 47 connects via outlet 33 to drain line 26 which drains into low pressure reservoir 12. A biasing spring 62 biases valve member 61 toward its second position, such that intermediate pressure seat 66 is shut when solenoid 46 is de-energized. The strength of biasing spring 62 should be sufficient to hold valve member 61 against intermediate pressure seat 66 in spite of the constant intermediate pressure in intermediate pressure passage 43. A first nozzle supply passage 32 branches from passage 43 to provide a continuous intermediate pressure supply of fuel to nozzle chamber 81. Those skilled in the art will appreciate that the described configuration and features of control valve assembly 44 might be modified significantly without departing from the intended scope of the present invention. For example, a pilot operated valve assembly might be employed rather than directly coupling the flow control valve member 61 to the electrical actuator armature 50. Further, a spool valve might be substituted for the poppet valve 60 shown.

The pressure intensifying mechanism 70 is positioned within injector body 40 and includes a piston 72 which is attached to a plunger 74. A relatively large hydraulic surface 71 on piston 72 is exposed to fluid pressure in actuation fluid cavity 45. A relatively small hydraulic surface 73 on the bottom of plunger 74 is exposed to fluid pressure in a fuel pressurization chamber 75. The alternately intermediate pressure or low pressure on the large hydraulic surface 71 of piston 72 from actuation fluid cavity 45 causes piston 72 and hence plunger 74 to move between an up position and a down position. A biasing spring 76 biases piston 72 toward its up position. The strength of biasing spring 76 is preferably such that it can move piston 72 and plunger 74 toward their up position when low pressure prevails in actuation fluid cavity 45. The size of hydraulic surface 71 should be such that when intermediate pressure prevails in actuation fluid cavity 45, piston 72 and plunger 74 are forced down to compress fuel in fuel pressurization chamber 75. When low pressure is returned to actuation fluid cavity 45, biasing spring 76 can move piston 72 and plunger 74 toward their up position, drawing fuel into fuel pressurization chamber 75 from a second nozzle supply passage 77 and expelling used actuation fuel into drain 47.

Fuel pressurization chamber 75 connects via second nozzle supply passage 77 to a nozzle chamber 81 which is defined by injector body 40. First nozzle supply passage 32 extends between fuel inlet 41 and a nozzle chamber 81, also defined by injector body 40, and supplies intermediate pressure fuel from intermediate pressure fuel supply line 24 to nozzle chamber 81. A check valve 90 is positioned within first nozzle supply passage 32 between inlet 41 and the junction 78 with second nozzle supply passage 77. Check valve 90 allows fuel to flow from inlet 41 toward nozzle chamber 81, but blocks flow from fuel pressurization chamber 75 back up the passage toward inlet 41. Thus, when plunger 74 moves from its down position back toward its up position, fuel can be drawn past check valve 90, through second nozzle supply passage 77, and into fuel pressurization chamber 75. When plunger 75 is subsequently driven downward, the pressurized fuel can be forced into nozzle chamber 81, but check valve 90 prevents the pressurized fuel from being forced back up first nozzle supply passage 32.

Needle valve 80 provides a needle valve member 82 which is moveable between an up position in which a nozzle outlet 89 is open and a down position in which it holds nozzle outlet 89 shut. Needle valve member 82 has been illustrated as a two piece valve member, although a one piece valve member might be substituted without departing from the scope of the present invention by moving spring 84 into chamber 85, or by eliminating spring 84 altogether. Needle valve member 82 has an opening hydraulic surface 93 which is exposed to fluid pressure from first nozzle supply passage 32 in nozzle chamber 81. Needle valve member 82 also has a closing hydraulic surface 86 which is exposed to fluid pressure in a needle control chamber 85, which is defined by injector body 40. A biasing spring 84 biases needle valve member 82 toward its down position. Needle valve member 82 and needle control chamber 85 are preferably sized such that a match clearance exists between valve member 82 and injector body 40. Preferably, this will prevent fuel from flowing around needle valve member 82 toward biasing spring 84. However, because some fuel leakage into the region around biasing spring 84 is possible, injector body 40 preferably defines a vent passage 83 that allows any fuel that might accumulate around biasing spring 84 to be expelled. Needle valve 80 has a valve opening pressure (VOP) which is defined in part by the pressures in nozzle chamber 81 and needle control chamber 85, and also in part by the strength of biasing spring 84. A branch passage 79 fluidly connects needle control chamber 85 and first nozzle supply passage 32. Needle control chamber 85 is also fluidly connected to a spill passage 88 that connects via outlet 87 to a low pressure line 28. Low pressure line 28 connects to the flow control switch 18 from FIGS. 1 and 2.

Needle control chamber 85 of injector 22 can be fluidly connected via flow control switch 18 and pressure reducing valve 20 with low pressure reservoir 12. By opening valve 20 the pressure in control chamber 85 can be reduced relatively quickly. Similarly, the pressure in needle control chamber 85 can be increased relatively quickly by closing pressure reducing valve 20. A first flow restriction orifice 91 is positioned where branch passage 79 opens to needle control chamber 85, and is sized to communicate pressure changes while simultaneously limiting flow volume through needle control chamber 85. A second flow restriction orifice 92 connects needle control chamber 85 with spill passage 88. The diameter of first flow restriction orifice 91 is preferably smaller than the diameter of second flow restriction orifice 92 to ensure that sufficient pressure drop in needle control chamber 85 occurs when pressure reducing valve 20 is opened. By adjusting the flow areas of orifices 91 and 92, different opening and closing characteristics of needle valve 80 can be achieved. In the preferred embodiment, the sizing of hydraulic surfaces 93 and 86, the strength of biasing spring 84, and the fluid pressure in rail 16 should be such that the VOP in nozzle chamber 81 is reached and needle valve member 82 can be lifted away from nozzle outlet 89 when the pressure in needle control chamber 85 is reduced by opening pressure reducing valve 20. Similarly, the closing of valve 20 should return sufficient pressure to needle control chamber 85 to force needle valve member 82 down to shut nozzle outlet 89. Engineering the surface sizes and spring strength appropriately, and setting the appropriate rail pressure, thus allows direct control over pilot injection by simply opening or closing pressure reducing valve 20. In this fashion, relatively small injections for pilot combustion or idle speed operation can be achieved at an intermediate but sufficient pressure independently of the action of the pressure intensifying mechanism 70. Injection of a relatively larger quantity of fuel can take place by supplying pressurized fuel to nozzle chamber 81 from the pressure intensification mechanism 70. A larger injection can occur with or without adjusting the pressure in needle control chamber 85. Larger volume injections are terminated when the pressure in nozzle chamber 81 is reduced.

Industrial Applicability

Referring now to FIG. 3, fuel injector 22 is shown with its various components in the positions they would occupy just prior to the initiation of a fuel injection event. Solenoid 46 is de-energized, flow control valve member 61 is in its second position, closing intermediate pressure seat 66. Actuation fluid cavity 45 is exposed to low pressure from fuel drain 47, and piston 72 and plunger 74 are biased toward their up position. Nozzle chamber 81 is supplied with pressurized fuel from rail 16 via passage 32. Fluid pressure in needle control chamber 85 and the force of biasing spring 84 act to hold needle valve member 82 in its down position, closing nozzle outlet 89.

Referring in addition to FIGS. 1 and 2, flow control switch 18 is shown in a position providing fluid communication between low pressure line 28 of a fuel injector 22 and vent line 30. When a relatively small pilot/idle injection is desired from the fluidly connected injector 22, pressure reducing valve 20 is opened. In the preferred embodiment, pressure reducing valve 20 is controlled with an electrical actuator that is preferably a solenoid, though some other suitable means or device such as a piezoelectric actuator might be used to open and close valve 20. When valve 20 opens, fluid communication is established with low pressure reservoir 12, and the pressure in vent line 30 and low pressure line 28, and hence spill passage 88 and needle control chamber 85, drops significantly. In the preferred embodiment, when the pressure in needle control chamber 85 drops, the relatively constant hydraulic pressure acting on needle opening hydraulic surface 93 is sufficient to open needle valve 80, and allow fuel to spray out nozzle outlet 89. Recall that a relatively constant medium hydraulic pressure is supplied to nozzle chamber 81 from the common rail 16. When termination of pilot injection is desired, current to pressure reducing valve 20 is stopped, and valve 20 closes. Because needle control chamber 85's fluid connection with low pressure reservoir 12 is closed, pressurized fuel entering needle control chamber 85 via branch passage 79 causes the pressure in needle control chamber 85 to rise relatively quickly. As the pressure in needle control chamber 85 rises, the hydraulic force exerted on needle closing hydraulic surface 86 forces needle valve member 82 down, closing nozzle outlet 89 and ending injection. Alternatively, needle valve 80 could be hydraulically balanced, and held in its closed position under the action of spring 84.

When a larger main injection is desired, current is supplied to solenoid 46. Armature 50 and valve member 61 are pulled up toward coil 48 to open intermediate pressure seat 66 and close low pressure seat 64. Fluid communication is established between intermediate pressure supply passage 43 and actuation fluid cavity 45, while fluid communication is closed between actuation fluid passage 45 and fuel drain 47. The increased pressure in actuation fluid cavity 45 exerts a hydraulic force on hydraulic surface 71 of piston 72. Piston 72 moves downward to pressurize fuel in fuel pressurization chamber 75 to a high pressure which is substantially higher than the pressure in rail 16. Pressurized fuel from fuel pressurization chamber 75 travels via second nozzle supply passage 77 to nozzle chamber 81, causing the pressure in nozzle chamber 81 to rise substantially. The increased hydraulic pressure in nozzle chamber 81 acts on needle opening hydraulic surface 93 to lift needle valve member 82 and open nozzle outlet 89, allowing fuel to spray into the combustion space.

When termination of main injection is desired, current to solenoid 46 is stopped. Biasing spring 62 acts to move valve member 61 back toward its second position, opening low pressure seat 64 and closing intermediate pressure seat 66. Actuation fluid passage 45 becomes fluidly connected with low pressure drain 47. As a result, the hydraulic force on hydraulic surface 71 of piston 72 is significantly decreased. Piston 72 and plunger 73 move under the hydraulic force on hydraulic surface 73 and the action of biasing spring 76 back toward their upward position. As plunger 73 is drawn upward, fuel is drawn into fuel pressurization chamber 75 from first nozzle supply passage 32 through second nozzle supply passage 77. Potentially, it would be desirable to eliminate spring 76 altogether. At the same time, the pressure in nozzle chamber 81 drops significantly. Hydraulic force in needle control chamber 85 and the force of biasing spring 84 can move needle valve member 82 down to close nozzle outlet 89, ending the injection event.

Figure 4:
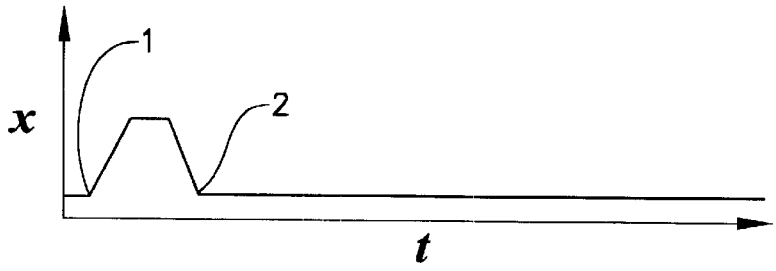
FIG. 4 is a graph of the pressure release valve position versus time during an example injection event.
Figure 5:
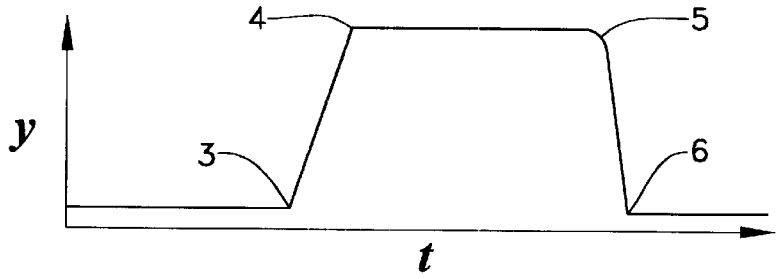
FIG. 5 is a graph of the flow control valve position versus time.
Figure 6:
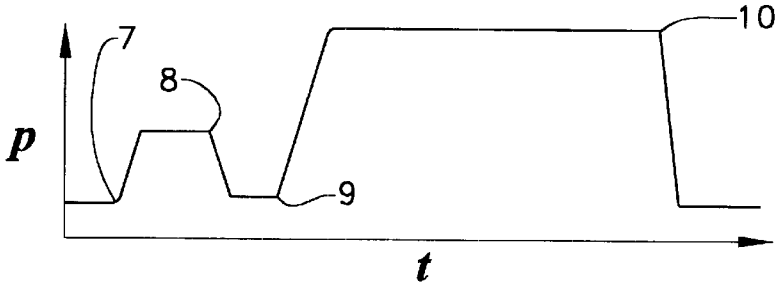
FIG. 6 is a graph of sac fuel pressure versus time.
Figure 7:
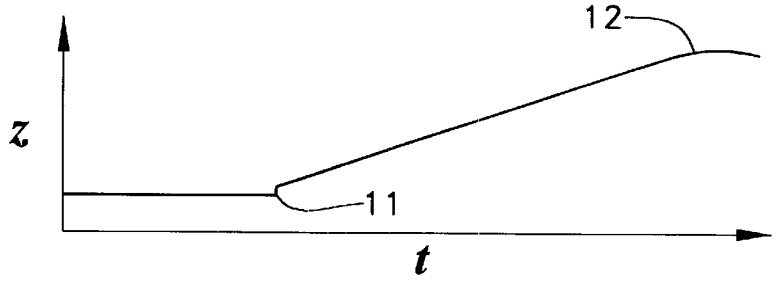
FIG. 7 is a graph of pressure intensifying element position versus time.
Figure 8:
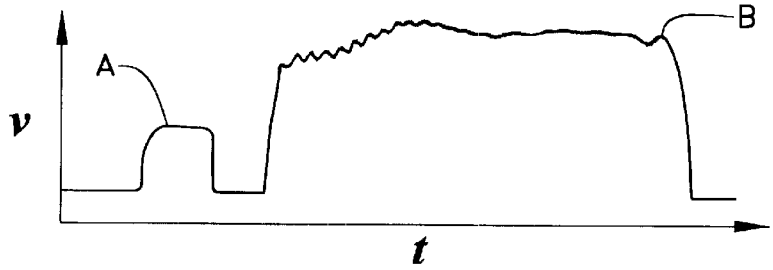
FIG. 8 is a graph of the injection mass flow rate versus time.

Referring to FIGS. 4–8, there are shown a variety of graphical illustrations of the positioning of fuel injection system components during injection events, the sac 100 pressure, and the rate shape of fuel injection itself. In FIG. 4, there is shown a graph representing the position (x) of the pressure release valve 20 over the time (t) of a pilot injection. Pressure release valve 20 is opened at "1" and closed at "2." FIG. 5 is a graph of the position (y) of flow control valve member 61 over the time (t) of a main injection event. Flow control valve member 61 begins to move from its second position at "3," reaches its first position at "4," begins its return at "5," and has returned to its second position at "6." FIG. 6 is a graph of the sac 100 pressure (p) over the time (t) of a pilot-main injection sequence. Because needle valve member 82 is biased against nozzle outlet 89, the nozzle sac 100 is isolated from nozzle chamber 81, and the pressure in sac 100 is zero between injection events. When a pilot injection is initiated, at "7," the sac 100 pressure rises. When the pilot injection is terminated, at "8," the sac 100 pressure falls back to zero. When a main injection is initiated at "9," the sac 100 pressure quickly rises in response to the opening of needle valve 80 and the pressure increase in nozzle chamber 81 from the action of pressure intensification mechanism 70. When needle valve 80 closes, the sac 100 pressure begins to drop at "10," and quickly returns to zero. FIG. 7 is a graph illustrating the position (z) of the pressure intensifying plunger 74 during the time (t) of the injection event. Piston 72 and plunger 74 begin to move downward to pressurize fuel at "11" shortly after flow control valve member 61 reaches its first position. When flow control valve member 61 begins to move back to its second position, at "12," the pressure in actuation fluid cavity 45 drops, and piston 72 and plunger 74 begin to move to their retracted, up, position. FIG. 8 is a graph illustrating the mass flow rate (v) through nozzle outlet 89 over the time (t) of a pilot injection (A) followed by a main injection (B).

The present invention helps to improve fuel efficiency and combustion burn quality by allowing separate control over pilot and main fuel injections. When the engine is operating at idle speed, relatively small injections using only rail pressure can be directly controlled by opening and closing pressure release valve 20. At higher engine loads or operating speeds, larger main injections at a relatively high pressure can be made using pressure intensification mechanism 70. Additionally, under certain operating conditions the injection of a small pilot quantity of fuel, followed by a main injection, or even a main injection followed by a pilot injection might be desirable. The present invention not only allows separate control over pilot and main injection, but provides greater versatility in injection rate shaping over prior art injectors by allowing the timing of the two injection types to be varied, producing square or ramp shaped injection rate profiles. For example, a small pilot injection might be initiated and a larger main injection triggered before cessation of the pilot injection.

It should be understood that the above description is for illustrative purposes only and is not intended to limit the scope of the present invention in any way. Although this invention is illustrated in the context of a variation on a hydraulically actuated unit injector as shown in commonly-owned U.S. Pat. No. 5,738,075, for example, one skilled in the art will recognize that this invention is equally applicable to other fuel systems such as the amplifier piston common rail system (APCRS) illustrated in the paper "Heavy Duty Diesel Engines—The Potential of Injection Rate Shaping for Optimizing Emissions and Fuel Consumption", presented by Messrs. Bernd Mahr, Manfred Durnholz, Wilhelm Polach, and Hermann Grieshaber; Robert Bosch GmbH, Stuttgart, Germany, at the 21st International Engine Symposium, May 4–5, 2000, Vienna, Austria. Thus, those, skilled in art will appreciate that various modifications could be made without departing from the intended scope of the present invention. For instance, while the preferred version of the invention has the pressure intensifying element and flow control valve connected to the injector body, these elements could be located separately and in different locations with suitable plumbing there between. Other aspects, objects, and advantages of this invention can be obtained from a study of the drawings, the disclosure, and the appended claims.

What is claimed is:

1. A fuel injector comprising:

an injector body defining an actuation fluid cavity, a fuel pressurization chamber, a nozzle chamber, a needle control chamber, an unobstructed needle control spill outlet, a fuel inlet and a nozzle outlet;

a pressure intensifying pumping element with a large hydraulic surface exposed to fluid pressure in said actuation fluid cavity and a small hydraulic surface exposed to fluid pressure in said fuel pressurization chamber;

said needle control chamber being fluidly connected to said fuel inlet and said needle control spill outlet;

a needle valve positioned in said injector body and including a closing hydraulic surface exposed to fluid pressure in said needle control chamber; and a flow control valve attached to said injector body and being movable between a first position in which said actuation fluid cavity is open to said fuel inlet, and a second position in which said actuation fluid cavity is closed to said fuel inlet.

2. The fuel injector of claim 1 wherein said injector body defined a nozzle supply passage extending between said fuel inlet and said nozzle chamber; and a check valve positioned in said nozzle supply passage.

3. The fuel injector of claim 2 wherein said nozzle supply passage is a first nozzle supply passage;

said injector body defines a second nozzle supply passage extending between said fuel pressurization chamber and said nozzle chamber.

4. the fuel injector of claim 3 including an electrical actuator attached to said injector body;

said flow control valve includes a poppet valve member attached to said electrical actuator.

5. The fuel injector of claim 4 including a needle spring operably positioned in said injector body to bias said needle valve toward a closed position; and said needle valve includes an opening hydraulic surface exposed to fluid pressure in said nozzle chamber.

6. The fuel injector of claim 5 wherein said injector body defines a fuel drain; and said actuation fluid cavity being closed to said fuel drain when said flow control valve is in said first position, but open to said fuel drain when said flow control valve is in said second position.

7. A fuel injection system comprising:

a source of intermediate pressure fuel;

a low pressure fuel reservoir;

at least one fuel injector having a pressure intensifying mechanism, needle valve, a flow control valve and a injector body defining a nozzle outlet and a needle control chamber fluidly connected to an unobstructed needle control spill outlet and a fuel inlet;

an intermediate pressure supply line extending between said source of intermediate pressure fuel and said fuel inlet;

a low pressure vent line located outside said injector body and extending between said needle control spill outlet and said low pressure reservoir; and a pressure release valve positioned in said vent line and having a first position in which said vent line is closed, and a second position in which said vent line is open.

8. The fuel injection system of claim 7 wherein said injector body defines an actuation fluid cavity and a fuel drain;

said pressure intensifying mechanism includes a pressure intensifying element positioned in said injector body and having a hydraulic surface exposed to fluid pressure in said actuation fluid cavity;

said flow control valve being attached to said injector body and moveable between a first position in which said actuation fluid cavity is open to said fuel inlet and closed to said fuel drain, and a second position in which said actuation fluid cavity is closed to said fuel inlet and open to said fuel drain; and a drain line extending between said fuel drain and said low pressure fuel reservoir.

9. The fuel injection system of claim 8 including a first electrical actuator operably connected to said flow control valve; and a second electrical actuator operably connected to said pressure release valve.

10. The fuel injection system of claim 9 wherein said source of intermediate pressure fuel is a common rail; and said at least one fuel injector is a plurality of fuel injectors.

11. The fuel injection system of claim 10 wherein said flow control valve includes a poppet valve member.

12. The fuel injection system of claim 11 wherein said injector body defines a nozzle supply passage extending between said fuel inlet and a nozzle chamber; and a check valve positioned between said nozzle chamber and said source of intermediate pressure fuel.

13. The fuel injection system of claim 12 wherein said nozzle supply passage is a first nozzle supply passage;

said injector body defines a second nozzle supply passage extending between a fuel pressurization chamber and said nozzle chamber.

14. The fuel injection system of claim 13 including a needle spring operably positioned in said injector body to bias said needle valve toward a closed position; and said needle valve includes an opening hydraulic surface exposed to fluid pressure in said nozzle chamber.

15. A fuel injection system comprising:

a source of intermediate pressure fuel;

a low pressure fuel reservoir;

at least one fuel injector having a pressure intensifying mechanism, a needle valve, a flow control valve and an injector body defining a nozzle outlet and a needle control chamber fluidly connected to a needle control spill outlet and a fuel inlet;

an intermediate pressure supply line extending between said source of intermediate pressure fuel and said fuel inlet;

a low pressure vent line extending between said needle control spill outlet and said low pressure reservoir;

a pressure release valve positioned in said vent line and having a first position in which said vent line is closed, and a second position in which said vent line is open;

wherein said at least one fuel injector is a plurality of fuel injectors; and a flow switch positioned between said pressure release valve and said needle control spill outlet of each said fuel injector, and said flow switch having a plurality of positions, a different fuel injector being fluidly connected to said pressure release valve at each of said plurality of positions.

16. A method of fuel injection, comprising the steps of:

injecting fuel at an intermediate pressure at least in part by fluidly connecting a nozzle chamber of a fuel injector to a source of intermediate pressure fuel;

injecting fuel at a high pressure at least in part by exposing a pressure intensifying mechanism to the source of intermediate pressure fuel; and said injecting steps each include a step of moving a pressure release valve located outside the fuel injector. from a closed position to an open position.

17. The method of claim 16 wherein said step of injecting fuel at an intermediate pressure includes a step of releasing pressure on a closing hydraulic surface of a needle valve positioned in the fuel injector.

18. The method of claim 17 including a step of ending injection of fuel at said intermediate pressure at least in part by exposing a closing hydraulic surface of the needle valve to the source of intermediate pressure fuel.

19. The method of claim 18 including a step of ending injection of fuel at said high pressure at least in part by moving a flow control valve to a position that exposes a pressure intensifying element of the pressure intensifying mechanism to a low pressure fuel drain.

20. The method of claim 19 including a step of providing a plurality of fuel injectors; and said step of releasing pressure includes a step of moving a flow switch to a position that opens a low pressure vent line of only one of said plurality of fuel injectors at a time.

21. A fuel injection system for an engine having a plurality of cylinders, comprising:

a source of intermediate pressure fuel;

a low pressure fuel reservoir;

a pressure intensifying mechanism, a flow control valve and an injector body associated with each engine cylinder, and each injector body defining a nozzle outlet and a needle control chamber fluidly connected to an unobstructed needle control spill outlet and a fuel inlet;

at least one intermediate pressure supply line extending from said source of intermediate pressure fuel to said pressure intensifying mechanism and to said fuel inlet;

a low pressure vent line located outside said injector body and extending between said needle control spill outlet and said low pressure reservoir; and a pressure release valve positioned in said vent line and having a first position in which said vent line is closed, and a second position in which said vent line is open.

22. The fuel injection system of claim 21 wherein said pressure intensifying mechanism defines an actuation fluid cavity and a fuel drain, and includes a pressure intensifying element having a hydraulic surface exposed to fluid pressure in said actuation fluid cavity;

said flow control valve being moveable between a first position in which said actuation fluid cavity is open to said at least one intermediate pressure supply line and closed to said fuel drain, and a second position in which said actuation fluid cavity is closed to said at least intermediate pressure supply line and open to said fuel drain; and a drain line extending between said fuel drain and said low pressure fuel reservoir.

23. The fuel injection system of claim 22, including a first electrical actuator operably connected to said flow control valve; and a second electrical actuator operably connected to said pressure release valve.

24. The fuel injection system of claim 23 wherein said source of intermediate pressure fuel is a common rail.

25. The fuel injection system of claim 24 wherein each said injector body defines a nozzle supply passage extending between said fuel inlet and a nozzle chamber; and a check valve positioned in said nozzle supply passage.

26. The fuel injection system of claim 25 wherein said nozzle supply passage is a first nozzle supply passage;

said pressure intensifying mechanism defines a fuel pressurization chamber; and a second nozzle supply passage extending between said fuel pressurization chamber and said nozzle chamber.

27. A fuel injection system for an engine having a plurality of cylinders, comprising:

a source of intermediate pressure fuel;

a low pressure fuel reservoir;

a pressure intensifying mechanism, a flow control valve and an injector body associated with each engine cylinder, and each injector body defining a nozzle outlet and a needle control chamber fluidly connected to a needle control spill outlet and a fuel inlet;

at lease on intermediate pressure supply line extending from said source of intermediate pressure fuel to said pressure intensifying mechanism and to said fuel inlet;

a low pressure vent line extending between said needle control spill outlet and said low pressure reservoir;

a pressure release valve positioned in said vent line and having a first position in which said vent line is closed, and a second position in which said vent line is open;

a low pressure vent line associated with each engine cylinder; and a flow switch positioned between said pressure release valve and each said needle control spill outlet, and said flow switch having a plurality of positions, a different low pressure vent line being fluidly connected to said pressure release valve at each of said plurality of positions.

* * * * *

UNITED STATES PATENT AND TRADEMARK OFFICE

CERTIFICATE OF CORRECTION

PATENT NO. : 6,568,369 B1 
DATED : May 27, 2003
INVENTOR(S) : Chetan J. Desai and Xinshaung Nan It is certified that error appears in the above-identified patent and that said Letters Patent is hereby corrected as shown below:

Column 9,
Line 4, the word "the" should be -- The --.
Line 24, insert the word "a" before the word "needle", and after the word "and", change "a" to -- an --

Column 12
Line 22, replace the words "lease on" with the words -- least one --.

Signed and Sealed this

Twenty-third Day of September, 2003

JAMES E. ROGAN
*Director of the United States Patent and Trademark Office*